US005499087A

United States Patent [19]

Hiraoka et al.

[11] Patent Number: 5,499,087

[45] Date of Patent: Mar. 12, 1996

[54] HEAT FIXING DEVICE AND ELECTROPHOTOGRAPHIC APPARATUS INCORPORATING THE SAME HAVING A PTC HEATING ELEMENT RECEIVED IN A RECESS OF A HOLDER

[75] Inventors: Chikara Hiraoka, Ibaraki; Junichi Matsuno, Toride; Masao Mitani, Mito; Hiroshi Oda, Ube; Toshikazu Tsumura, Kure, all of Japan

[73] Assignees: Hitachi, Ltd., Tokyo; Ube Industries, Ltd., Ube; Hitachi Koki Co., Ltd., Tokyo, all of Japan

[21] Appl. No.: 57,637

[22] Filed: May 7, 1993

Related U.S. Application Data

[63] Continuation-in-part of Ser. No. 870,297, Apr. 17, 1992, Pat. No. 5,351,114.

[30] Foreign Application Priority Data

| | | | |
|---|---|---|---|
| Apr. 22, 1991 | [JP] | Japan | 3-090552 |
| Jun. 26, 1991 | [JP] | Japan | 3-154350 |
| May 11, 1992 | [JP] | Japan | 4-117167 |

[51] Int. Cl.[6] ..... G03G 15/20

[52] U.S. Cl. ..... 355/285; 219/216; 355/290

[58] Field of Search ..... 355/282, 285, 355/286, 289, 290, 295; 219/216, 469–471; 430/60; 118/60

[56] References Cited

U.S. PATENT DOCUMENTS

| | | | |
|---|---|---|---|
| 3,811,828 | 5/1974 | Ohta et al. | 219/216 X |
| 4,253,007 | 2/1981 | Dannatt | 219/216 |
| 4,266,115 | 5/1981 | Dannatt | 219/216 |
| 4,320,284 | 3/1982 | Dannatt | 219/469 |
| 4,329,566 | 5/1982 | Hooper | 219/216 |
| 4,365,139 | 12/1982 | Dannatt | 219/216 |
| 4,544,828 | 10/1985 | Shigenobu et al. | 219/216 |
| 4,628,183 | 12/1986 | Satomura | 219/216 |
| 5,115,278 | 5/1992 | Maruta et al. | 355/285 |
| 5,149,941 | 9/1992 | Hirabayashi et al. | 355/290 X |
| 5,191,381 | 3/1993 | Yuan | 355/285 |
| 5,262,834 | 11/1993 | Kusaka et al. | 355/285 |
| 5,278,618 | 1/1994 | Mitani et al. | 355/285 |
| 5,300,997 | 4/1994 | Hirabayashi et al. | 355/285 |

FOREIGN PATENT DOCUMENTS

| | | |
|---|---|---|
| 63-313182 | 12/1988 | Japan . |
| 2-158782 | 6/1990 | Japan . |
| 3-025475 | 2/1991 | Japan . |

*Primary Examiner*—A. T. Grimley
*Assistant Examiner*—Shuk Y. Lee
*Attorney, Agent, or Firm*—Antonelli, Terry, Stout & Kraus

[57] ABSTRACT

A heat fixing device includes a heating head formed by attaching a radiant plate to the radiant surface of a PTC heating element using an adhesive having an excellent thermal conductivity, and embedding a heating unit, of which surfaces except the radiant surface are shielded with an adiabatic material, in a recess formed in a holder for supporting the heating unit.

23 Claims, 8 Drawing Sheets

HEAT FIXING DEVICE AND ELECTROPHOTOGRAPHIC APPARATUS INCORPORATING THE SAME HAVING A PTC HEATING ELEMENT RECEIVED IN A RECESS OF A HOLDER

CROSS-REFERENCE TO RELATED APPLICATION

This is a contiunuation-in-part application of U.S. patent application Ser. No. 07/870,297, filed Apr. 17, 1992, and now U.S. Pat. No. 5,351,114, issued Sep. 27, 1994, the disclosure of which is incorporated herein by reference.

BACKGROUND OF THE INVENTION

1. Field of the Invention

The present invention relates to a heat fixing device and an electrophotographic apparatus having the heat fixing device. In particular, this invention is concerned with a heat fixing device that uses a PTC heating element, i.e., an element having a positive temperature coefficient of resistivity, as a heating element which applies heat energy to a recording material via a belt, and also concerned with an electrophotographic apparatus incorporating the heat fixing device.

2. Description of the Related Art

A fixing device of the type known as heat roller-type fixing device is widely used in various electrophotographic apparatus such as a copying machine or an optical printer. This fixing device comprises a heating roller that has a built-in heater and held at a predetermined temperature, and a pressurizing roller that is coated with an elastic layer, and pressed against the heating roller. These rollers cooperate with each other to nip therebetween a recording medium such as a paper sheet carrying unfixed toner image so as to thermally fix the toner image by applying pressure while conveying the recording medium.

According to this heat roller fixing method, since the heating roller has a large heat capacity, it takes much time (warm-up time) until the heating roller is heated up to a temperature high enough to fix the toner image. In addition, a large power is consumed for maintaining the temperature.

In addition, it is not easy to set the temperature and angle of a point at which the recording material is peeled off from the heating roller. Consequently, problems are caused such as adhesion of toner to the heating roller (referred to as "offset") or clinging of the recording paper sheet around the heating roller.

Various belt-type fixing devices have been proposed to overcome these problems. One of such the belt-type fixing devices employs a belt which is moved in contact with a heating unit, a pressing member which presses a recording medium into close contact with the side of the belt opposite to the side contacting the belt, the heating unit being moved together with the belt, whereby heat energy is applied from the heating unit to the recording material via the belt.

The belt-type fixing device offers a higher heat efficiency than the heat roller fixing technique, and reduces a warm-up time and a power consumption. After heated and melted, toner on paper is cooled down sufficiently and fixed to the paper. The heating unit is then separated from the belt.

A thick-film heater, a halogen lamp, a PTC heating element or the like has been proposed for use as the heating unit employed in the belt-type fixing technique. Japanese Patent Laid-Open No. 63-313182 uses a thick-film heater that is made by coating an alumina substrate with a linear or a belt-like electrical resistive material made of Ta2N or the like and that has a low heat capacity. The surface of a heating unit has a $Ta_2O_5$ layer that protects the heating unit from the rubbing against the belt. A technique using the radiant heat of, for example, a halogen lamp has been disclosed in U.S. Pat. No. 3,811,828 or Japanese Patent Laid-Open No. 3-25475. Japanese Patent Laid-Open No. 2-158782 discloses a technique in which a PTC heating element is employed as a heating unit. The PTC heating element is united with a linear heating plate, which is made of a metal such as alumminium or copper, or a ceramic such as alumina, by means of an adhesive.

Among the foregoing heating units, a heating unit based on a PTC heating element facilitates the detection and control of its temperature, as compared to a heating unit using a thick-film heater or a halogen lamp, and enables easier reduction of maximum power consumption than any other heating unit. This is because the PTC heating element has such a self-temperature control ability that, when the own-temperature reaches a temperature inherent to the material of the PTC heating element (Curie point), the resistance increases drastically to suppress heating.

When a PTC heating element is employed in a belt-type heat fixing device, a pinch effect specific to the PTC heating element (a phenomenon that when a temperature distribution varies in the PTC heating element, current is restricted so that the heating value decreases eventually) makes it impossible to fully utilize the heating value of the PTC heating element. Even when the temperature on a radiant surface of the PTC heating element decreases due to heat absorption by belt, if the temperatures of the other portions than the radiant surface reach the Curie temperature, the current value decreases with the resistance held high, failing to raise the temperature of the radiant surface.

When a supporting material for the PTC heating element deforms with heat, a gap is created between the radiant surface of the heating unit and the belt. Heat is not therefore supplied to the belt effectively, or the contact between the PTC heating element and electrodes becomes imperfect. This causes an arc discharge, resulting in breakdown of the PTC heating element.

In a belt-type heat fixing device using a PTC heating element, it is necessary that, even when the supporting member for the PTC heating element deforms by heat, good electrical contact is maintained between the PTC heating element and electrodes, as well as good thermal contact between the radiant surface of the heating unit and the belt. It is also necessary that the temperature distribution throughout the PTC heating element is as uniform as possible, and that the temperature of the entire PTC heating element is sensitive and responsive to a change in the temperature of the belt.

Japanese Patent Laid-Open No. 2-158782 discloses such a structure that a thinned PTC heating element is united with a linear heating plate, made of a metal such as aluminum or copper, or a ceramic such as alumina, by means of an adhesive. The temperature distribution in the PTC heating element is thus made uniform. However, no consideration has been given to the imperfect electric contact between the PTC heating element and the electrodes, and the imperfect thermal contact between the heating unit and the belt, which result from the thermal deformation of a supporting material for the heating unit. This brings about the aforesaid problems, causing impediment to the practical application of the prior art.

SUMMARY OF THE INVENTION

An object of the present invention is to overcome the problems in regard to inferior electrical and thermal contacts in a belt-type heat fixing device using a PTC heating element, by providing a highly-reliable heat fixing device, as well as an electrophotographic apparatus using the heat fixing device.

An aspect of the present invention provides a belt-type fixing device using a PTC heating element, wherein the PTC heating element is received in a recess formed in a holder for holding the PTC heating element, through the intermediary of an heat- and electrical-insulating member.

Another aspect of the present invention provides a belt-type heat fixing device using a PTC heating element, wherein the PTC heating element is received in a recess formed in a holder for holding the PTC heating element through the intermediary of an elastic member.

Yet another aspect of the present invention provides a heat fixing device in which a PTC heating element is received in a recess in a holder for holding the PTC heating element through the intermediary of a heat- and electrical-insulating member, with an elastic member placed between the insulating material and the holder.

Preferably, a radiant plate is attached to a radiant surface of the PTC heating element by means of an adhesive having an excellent thermal conductivity. More preferably, at least the surface of the radiant plate contacting a heat resistant belt or the surface of a heating head, which is made by mounting the PTC heating element and the holder, contacting the heat resistant belt is coated with an electrical-insulating material having an excellent lubricity. More preferably, when the PTC heating element is mounted in the holder directly or via the heat- and electrical-insulating material, an elastic member having a rubber hardness of 50° to 70° is placed between the PTC heating element and holder. The holder may be made of an electrical-insulating material.

The PTC heating element may consist of a plurality of chips. The chips may be arranged in a row or in rows on the radiant plate attached to the radiant surface of the PTC heating element.

The radiant plate attached to the radiant surface of the PTC heating element may have a convex surface as a surface contacting the heat resistant belt.

Yet another aspect of the present invention provides a heat fixing device comprising an endless heat resistant belt, a driving roller for rotating the heat resistant belt, and a holder that contacts the heat resistant belt and supports the PTC heating element, wherein a radiant plate is attached to the radiant surface of the PTC heating element using an adhesive having an excellent thermal conductivity, the other surfaces of the PTC heating element except the radiant plate-attached surface are coated with a heat- and electrical-insulating material, and the PTC heating element is received in the recess formed in the holder with an elastic member interposed therebetween. At least the surface of the radiant plate contacting the heat resistant belt is coated with an insulating material having an excellent lubricity.

Yet another aspect of the present invention provides an electrophotographic apparatus comprising a photosensitive drum, a means for forming an electrostatic latent image on the surface of the photosensitive drum, developing means that develops the electrostatic latent image formed on the surface of the photosensitive drum to produce a toner image, a transfer means for transferring the toner image onto paper sheet, and heat fixing means for fixing the toner image transferred onto the paper, wherein the heat fixing means is any of the aforesaid heat fixing devices.

According to the present invention, a PTC heating element and a radiant plate are fixed to each other using an adhesive having an excellent thermal conductivity, and the other surfaces of the PTC heating element are enclosed with a heat-insulating member, thus forming a heating unit. This causes the temperature of the entire PTC heating element to depend largely on the temperature of the radiant plate. The pinch effect of the PTC heating element can thus be minimized. The heating unit is isolated from heat by the heat- and electrical-insulating member and received in the recess formed in the holder, which alleviates thermal deformation resulting from a difference in thermal expansion between the heating unit and holder. An elastic member placed in the recess of the holder improves the alignment of the radiant surface of the heating unit and the contact between the electrodes and PTC heating element.

The surface of the radiant surface is coated with a heat-insulating lubricant, which improves the sliding smoothness between the radiant surface and heat resistant belt. The elastic member should have such an elasticity that the pressing force of a pressurizing roller causes the radiant surface to become flush with the surface of the holder. This is because if the elasticity is too low, the force of the holder for pressing the heat resistant belt causes the radiant surface to sink in the recess of the holder, resulting in an imperfect contact with the heat resistant belt. Conversely, a too large elasticity causes an increase in the resistance of contact between the radiant surface and the heat resistant belt.

DETAILED DESCRIPTION OF THE PREFERRED EMBODIMENTS

An embodiment of the present invention will be described with reference to FIGS. 1 to 7.

Figure 1:
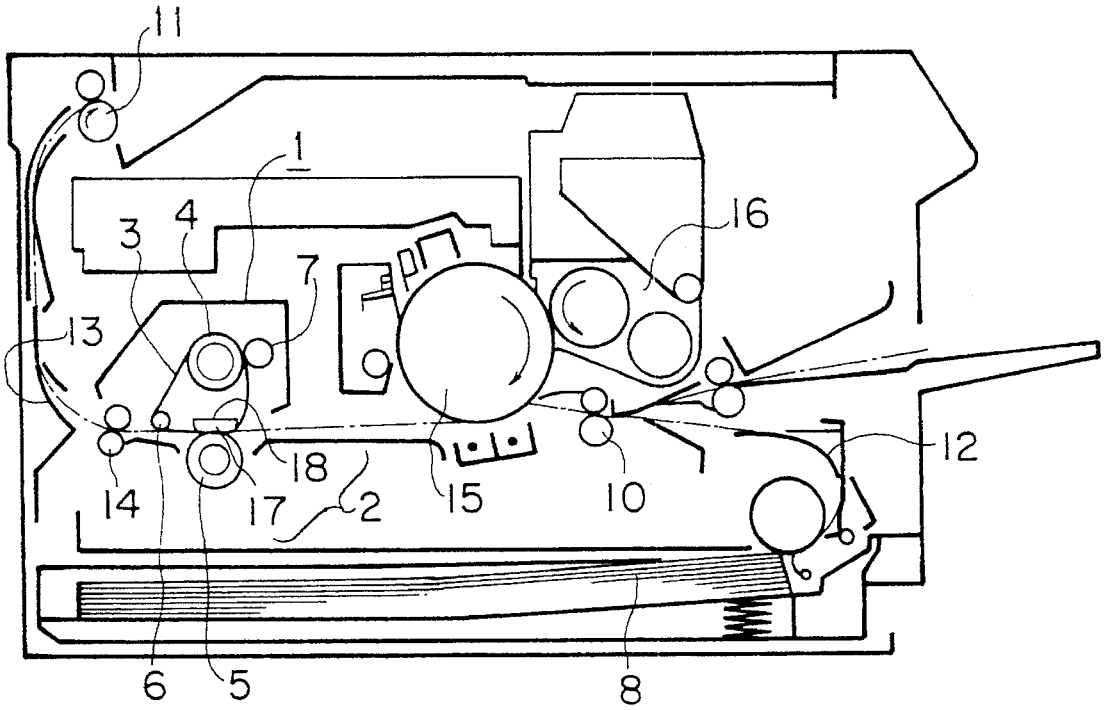
FIG. 1 is a cross-sectional view of an electrophotographic apparatus of an embodiment of the present invention.

Referring to FIG. 1, a dot-dash line indicates a flow of paper sheet. First, paper sheets 8 stacked in a hopper are fed one after another and carried to a curved guide 12. Feeding rollers 10 feed each paper sheet 8 to a toner transfer section of a photosensitive drum 15. A toner image on the photosensitive drum 15 is visualized by a developing device 16. Thereafter, the paper sheet 8 is transported to a belt-type heat fixing device 1 comprising an endless heat-resistant fixing belt 3, a driving pulley 4, a heating head 2 including a heating unit 17 comprising a PTC heating element received in a recess in a holder 18, a pressure roller 5, a peeling roller 6, and an auxiliary roller 7. The toner image is fixed to the paper sheet 8. The paper sheet 8 is then sent to a curved guide 13 by feeding rollers 14, and then discharged to an output tray (not shown) by discharge rollers 11.

Figure 2:
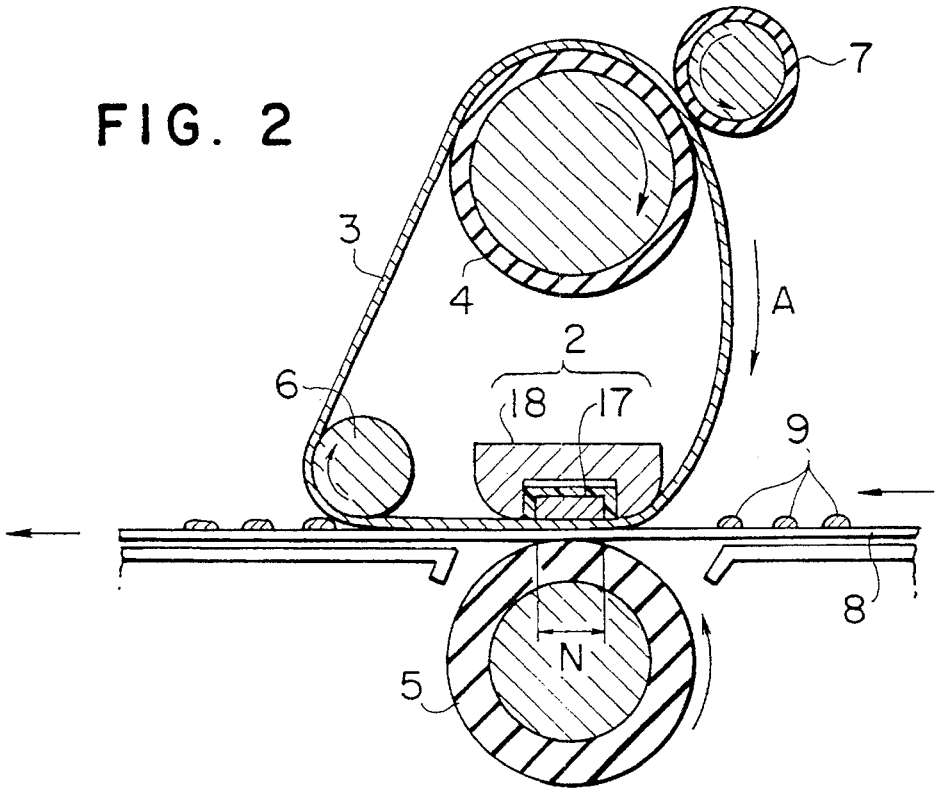
FIG. 2 is a cross-sectional view of a heat-fixing device employed in the embodiment shown in FIG. 1.

FIG. 2 shows the structure of the belt-type heat fixing device 1. The operation of the belt-type heat fixing device 1 will be described below.

The endless fixing belt 3 is rotated in a direction indicated by an arrow A by a driving pulley 4 to run to a nip N at which the endless fixing belt 3 and a paper sheet 8 carrying non-fused toner 9 come into contact with the heating unit 17 and the pressing roller 5. The fixing belt 3 is heated by the heat of the heating unit 17 and then cooled down sufficiently by the holder 18 and air. The belt 3 is then separated from the paper sheet 8 by the peeling roller 6. Thus, the nonfused toner 9 on the paper sheet 8 is heated and melted at the nip N, then cooled down to adhere to the paper sheet 8, and then separated from the fixing belt 3. Consequently, so-called "high-temperature offset", that is, adhesion of the melted toner to the surface of the fixing belt, does not occur.

The fixing belt 3 is thin enough to transmit heat of the heating unit 17 to the toner and the paper sheet sheet 8 instantaneously, and whose surface coming into contact with the paper 8 is coated with a fluororesin so as to part from toner easily. In this embodiment, the fixing belt 3 is formed of a nickel substrate of 30 μm thick whose surface is coated with a PTFE (tetrafluorothyene resin) layer of 20 μm thick containing a conducting material. A film made of a heat resistant resin such as polyimide or polyetherimide may be employed as the fixing belt 3.

The driving pulley 4 or supplementary roller 7 is made by coating a metallic roller with a silicon rubber showing a high heat resistance and high coefficient of friction, which prevents any slip between the driving pulley 4 and fixing belt 3. Instead of being coated with the silicon rubber, the driving pulley 4 may be knurled to have a fine irregular surface. The pressurizing roller 5 is made by coating a base made of aluminum or stainless steel with silicon rubber. The axially-longitudinal shape of the pressurizing roller 5 is like an upside-down crown, which prevents paper from wrinkling.

The structure of the heating head 2 of this embodiment will be described with reference to FIGS. 3 to 5.

Figure 3:
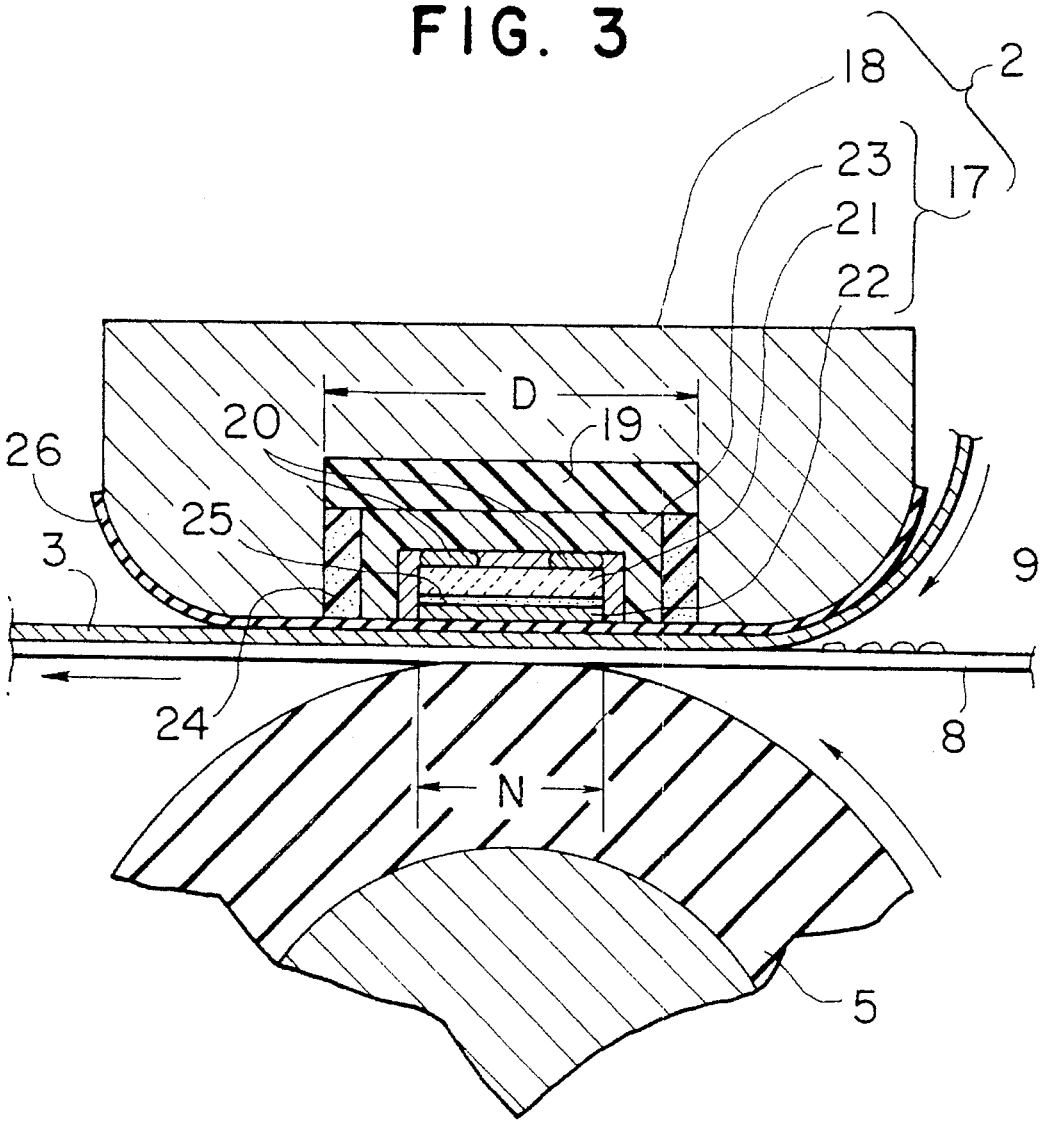
FIG. 3 is an enlarged cross-sectional view of a heating head.

FIG. 3 is a sectional view of the heating head 2. The heating head 2 consists of two parts; that is, a heating unit 17 and a holder 18. The heating unit 17 is fixed in a recess of a width D formed in the holder 18, by means of an elastic adhesive 24 which is insulating both thermally and electrically. This structure offers an advantage that any difference in thermal expansion between the heating unit 17 and holder 18 is absorbed by the adhesive layer 24. This eventually prevents the heating unit 17 from bending or twisting. A silicon or polyimide adhesive is adopted as the adhesive 24 in this embodiment.

The holder 18 is made of aluminium in this embodiment, so that, when the radiant surface of the heating unit 17 is brought into close contact with the fixing belt 3 under pressure exerted by the pressing roller 5, the fixing belt 3, which has passed through the nip N, can be cooled down effectively. The holder may be made of a material other than aluminum, such as polyphenylene sulfide, polyamidoimide, polyimide, polyether ketone, a high heat resistant+resin such as liquid polymer, or a compound of any of these resins with a ceramic, metal, or glass, although aluminum is used in this embodiment.

An elastic member 19 is a sheet made of silicon rubber, having dimensions of 240 mm length, 12 mm width and 1.5 mm thickness and a rubber hardness of 50° Hs. The elastic member 19 pressurizes the heating unit 17 uniformly with its elasticity, so that even if the heating unit 17 or holder 18 deforms with heat, the radiant surface of the heating unit 17 does not sink into the recess of the holder, thus eliminating any imperfect contact between the radiant surface and fixing belt 3, ensuring that a PTC heating element 21 having a positive temperature coefficient characteristic comes into contact with conduction wires 20. Although the described embodiment employs a silicon rubber having a rubber hardness of 50° Hs which is used as the material of the elastic member 19, it was confirmed that a silicon rubber having a rubber hardness of 70° Hs provides an equivalent effect. Alternatively, a leaf spring or a coil spring may be adopted as the elastic member 19.

The heating head 2 is formed by mounting the heating unit 17 in the holder 18 as described before. The surface of this unit 17 contacting the fixing belt is coated with a layer of an electrically-insulating, heat- and abrasion-resistant lubricant 26. The lubricant 26 is formed by adding a fluororesin to a polyimide base material, and the layer is formed by baking this resinous material. This lubricant 26 improves the sliding smoothness between the heating head 2 and fixing belt 3. The surface may be coated with a layer of disulfuric acid molybdenum formed by baking, thus providing an electrically-insulating lubricant means having resistance both to heat and abrasion. Alternatively, the surface made of a heat resistant resin such as polyimide or polytherimide may be coated with a film having a layer made of fluorine-contained resin such as PTFE. The radiant surface of the heating unit 17 alone may be coated with the lubricant 26.

The radiant surface of the heating unit 17 is formed by attaching a radiant plate 22 to the surface of the PTC heating element 21 facing the pressing roller 5 by means of an adhesive 25 having an excellent thermal conductivity and electrical-insulating capability, while other surfaces of the element 21 are enclosed with a heat-insulating frame 23. The heat energy generated by the PTC heating element 21 is transmitted to the fixing belt 3 via the radiant plate 22. The radiant plate 22 therefore should be made of a material having high thermal conductivity and be as thin as possible. In this embodiment, an aluminum member having external dimensions of 240 mm (length), 8 mm (width) and 0.3 mm (thickness) is used as the radiant plate 22. A silicon adhesive containing an alumina filler and having an excellent thermal conductivity is suitably used as the adhesive 25.

As the material of the heat-insulating frame 23, PPS resin is used in the illustrated embodiment. The heat-insulating frame 23, however, may be made of a high heat-resistant resin such as PAI, PI, PEEK, or liquid polymer, or a compound of any of these resins with a ceramic, metal, or glass. The PTC heating element 21 is formed by arranging multiple plate chips, each having dimensions of 20 mm (length), 8 mm (width) and 1.0 mm (thickness) and made by baking barium titanate, mutually tightly in the longitudinal direction on the back of the radiant plate 22 that is opposite to the surface contacting the fixing belt 3. With this arrangement, it is possible to obtain any desired temperature distribution of the heating unit 17 in the longitudinal direction of the unit, by suitably combining PTC heat generating chips having different Curie temperatures.

Figure 4:
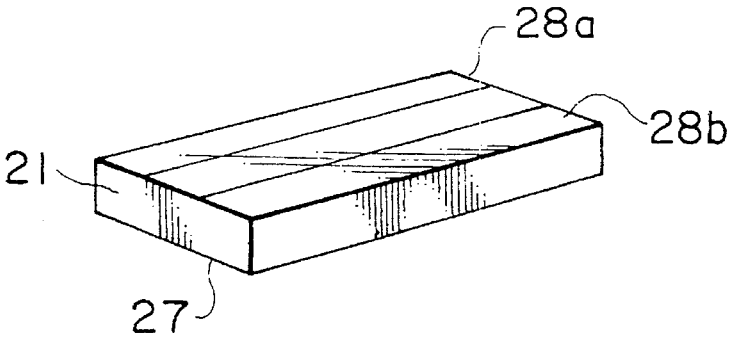
FIG. 4 is a perspective view of a PTC heating element chip.
Figure 5:
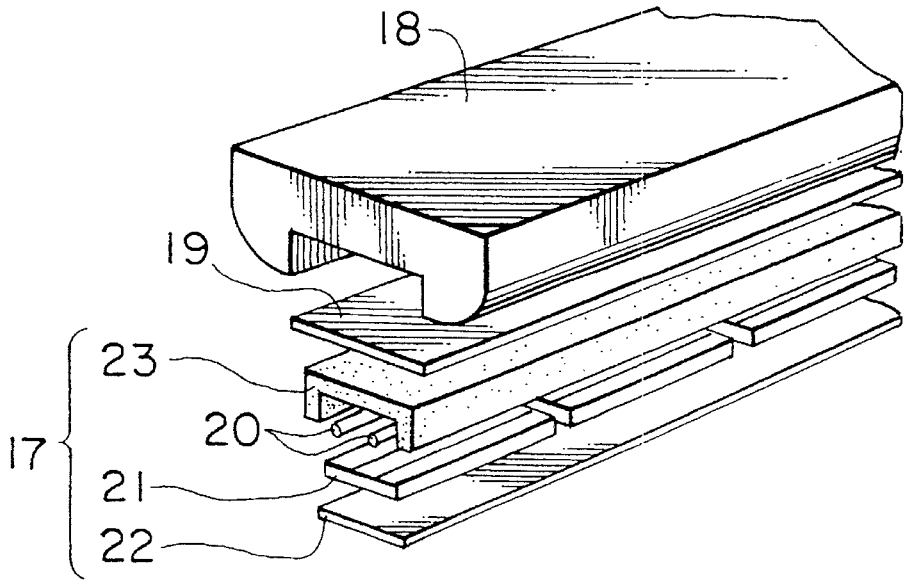
FIG. 5 is a perspective view showing the structure of the heating head.

FIG. 4 shows an electrode surface of the PTC heating element chip 21. Electrodes are formed on two surfaces of the PTC heating element chip 21 across the thickness thereof. A full electrode 27 is formed on one of the surfaces, while the electrode on the other side is divided into segment electrodes 28*a* and 28*b* which are spaced in the longitudinal direction. As apparent from FIG. 5 showing the structure of the heating head, the surfaces of the chips, each of which has the full electrode 27, are held in contact with the radiant plate 22 to form a radiant surface. Conductor wires 20 are secured to the surfaces of the chips having the segment electrodes 28*a* and 28*b* by means of an adhesive or pressed to the same by means of the heat-insulating frame 23. The PTC heating element chips 21 are arranged densely with small spacing in the longitudinal direction of the heating head. An alternative way of connection to the electrodes on the PTC heating element is that two surfaces of the PTC heating element across the thickness or width are formed as full non-segmented electrodes for electrical power supply. In this embodiment, the radiant surface is so wide that the temperature of the radiant surface can dominate the temperature of the entire PTC heating element. Furthermore, the difference in temperature between the segment electrodes 28*a* and 28*b* can be minimized, thereby preventing the pinch effect of the PTC heating element.

The advantages of the described embodiment will be described in conjunction with FIGS. 6 and 7.

Figure 6:
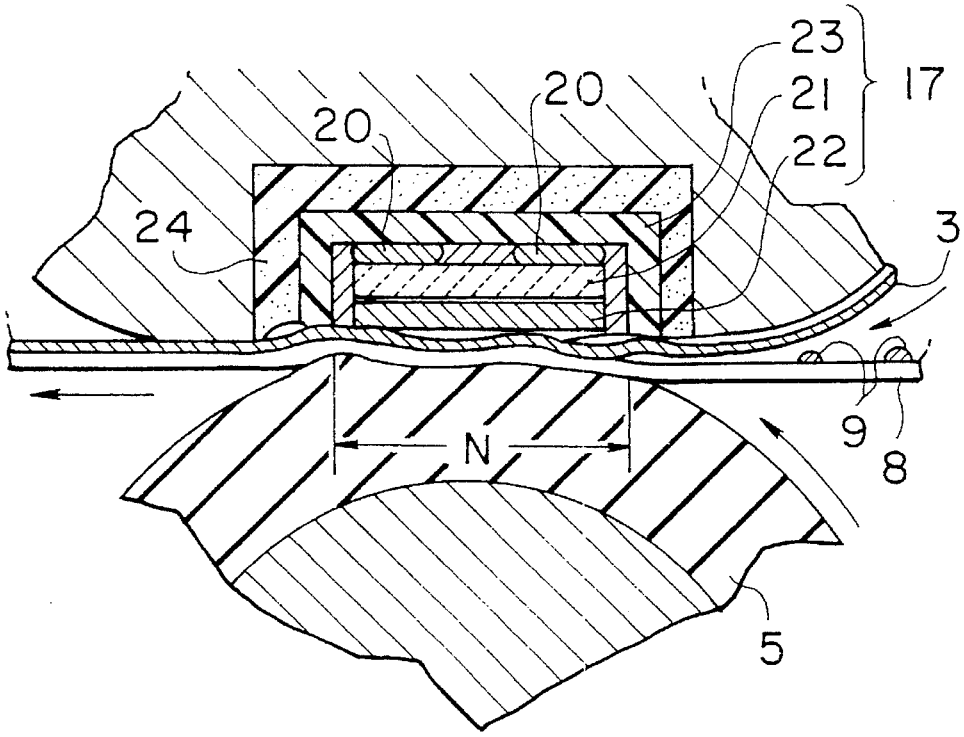
FIG. 6 is a cross-sectional view showing the movement of a heating unit.

FIG. 6 is an enlarged view of a heating unit that is received in the recess of a holder but devoid of the elastic member. To fix toner 9 on the paper sheet 8, the temperature of the fixing belt 3 at the nip N must range from, for example, 140° C. to 180° C. which is high enough to melt toner. The radiant plate 22 and fixing belt 3, however, experience out-of-plane deformation due to heat, with the result that the heating unit 17 sinks into the bottom of the recess of the holder. A minute gap is then created between the radiant plate 22 and the fixing belt 3, diminishing the area of actual contact and, accordingly, impeding transfer of the heat from the radiant plate 22 to the fixing belt 3, thus impairing the efficiency of fixing of the toner 9 to the paper sheet 8.

Figure 7:
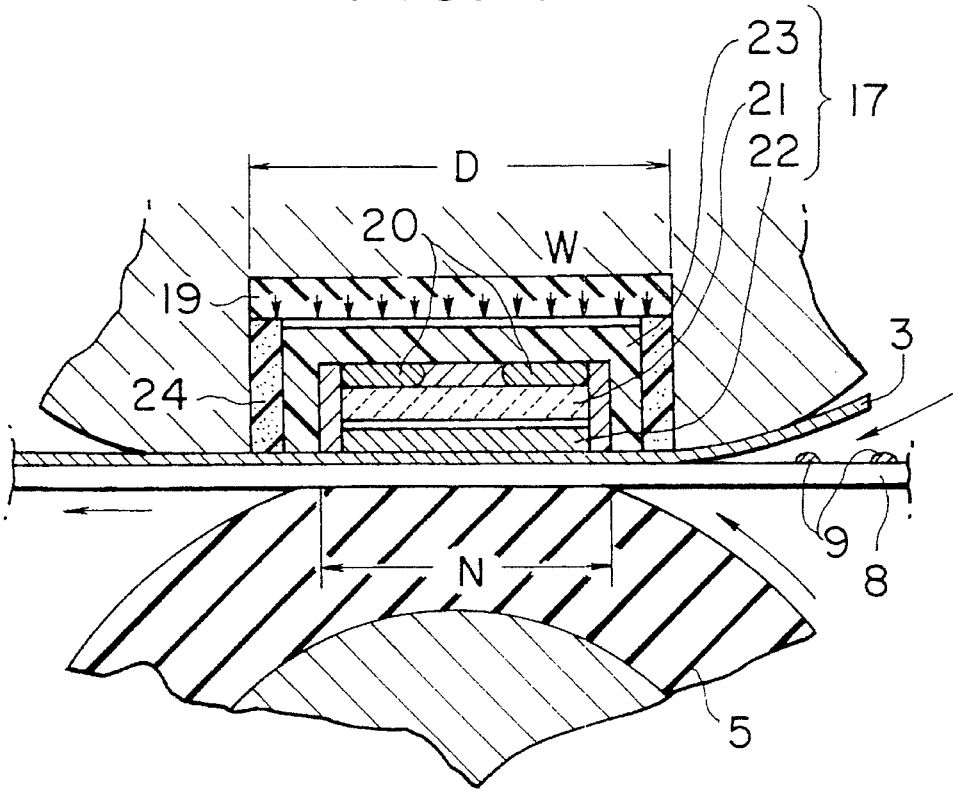
FIG. 7 is a cross-sectional view used for explaining the operation of an elastic member.

In order to eliminate such a problem, as shown in FIG. 7, this embodiment employs the elastic member 19 mounted on the bottom of the recess in the holder, over the breadth D of the recess. The elastic member 19 prevents the heating unit 17 from sinking and presses the heating unit 17 uniformly so that the radiant plate 22 is pressed into close contact with the fixing belt 3. The arrangement is such that, with the elastic member 19 thus mounted, the surface of the radiant plate 22 contactable with the fixing belt 3 slightly projects from the surface of the holder 18. According to this arrangement, when the holder having the foregoing structure is pressed onto the pressing roller 5 via the fixing belt 3, the elastic member 19 is compressed to allow the projecting surface of the radiant plate 22 to become substantially flush with the surface of the holder 18. In addition, an elastic force w resulting from the compression of the elastic member 19 facilitates the contact between the radiant plate 22 and the fixing belt 3, as will be seen from FIG. 7. The elastic member 19 also serves to prevent separation of the PTC heating element 21 from the wires 20 and the separation of the same from the radiant plate 22.

Figure 8:
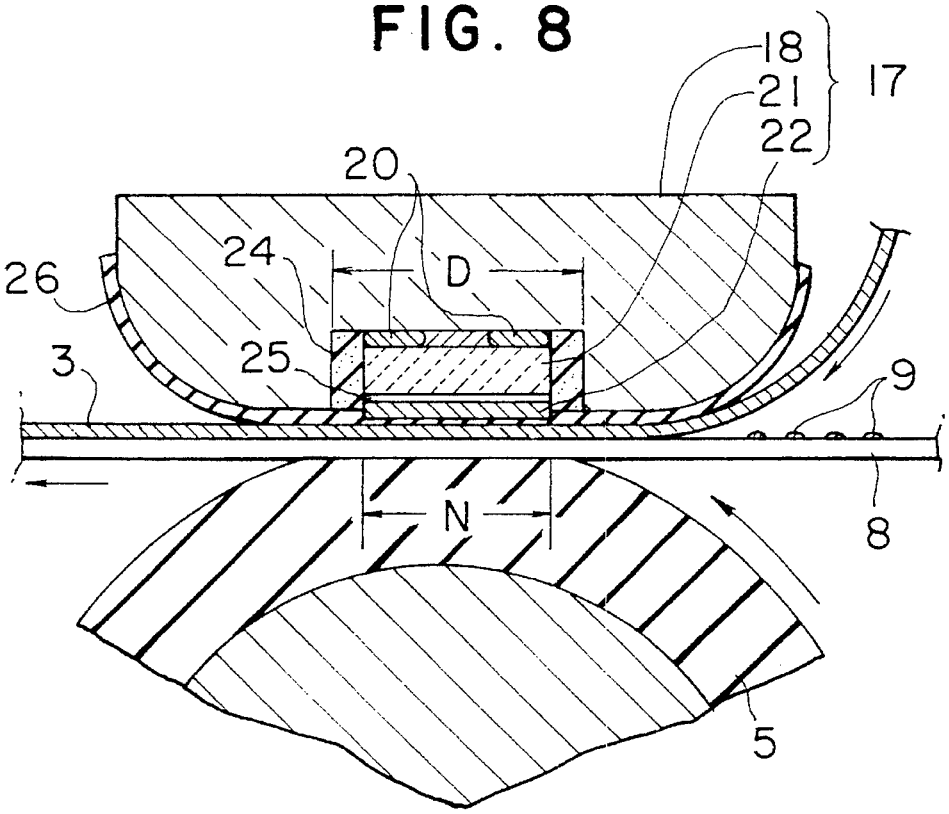
FIG. 8 is a cross-sectional view of the heating head of another embodiment of the present invention.

FIG. 8 shows another embodiment of the present invention. In this embodiment, a heat- and electrically-insulating PPS resin is used as the material of a holder 18. In addition, an elastic adhesive 24 is used to secure the wires 20 and so forth to the PTC element 21.

The embodiment shown in FIG. 8 is different from the embodiment described before in that the heat-insulating frame 23 is extended to form a holder, so that the elastic member placed between the recess in the holder and the heating unit can be dispensed with. This embodiment adopts the PPS resin as the material of a holder. Instead of the PPS resin, a polyimide resin or a compound of any of these resins with a ceramic, metal, or glass may be used.

Figure 9A:
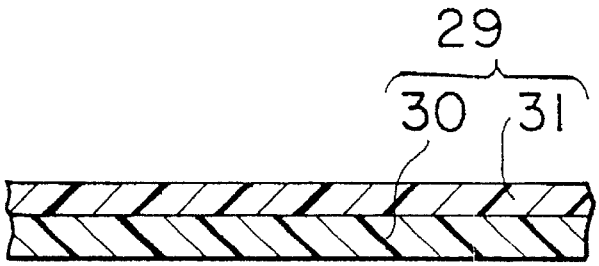
FIGS. 9A and 9B are views illustrative of a further embodiment of the present invention.
Figure 9B:
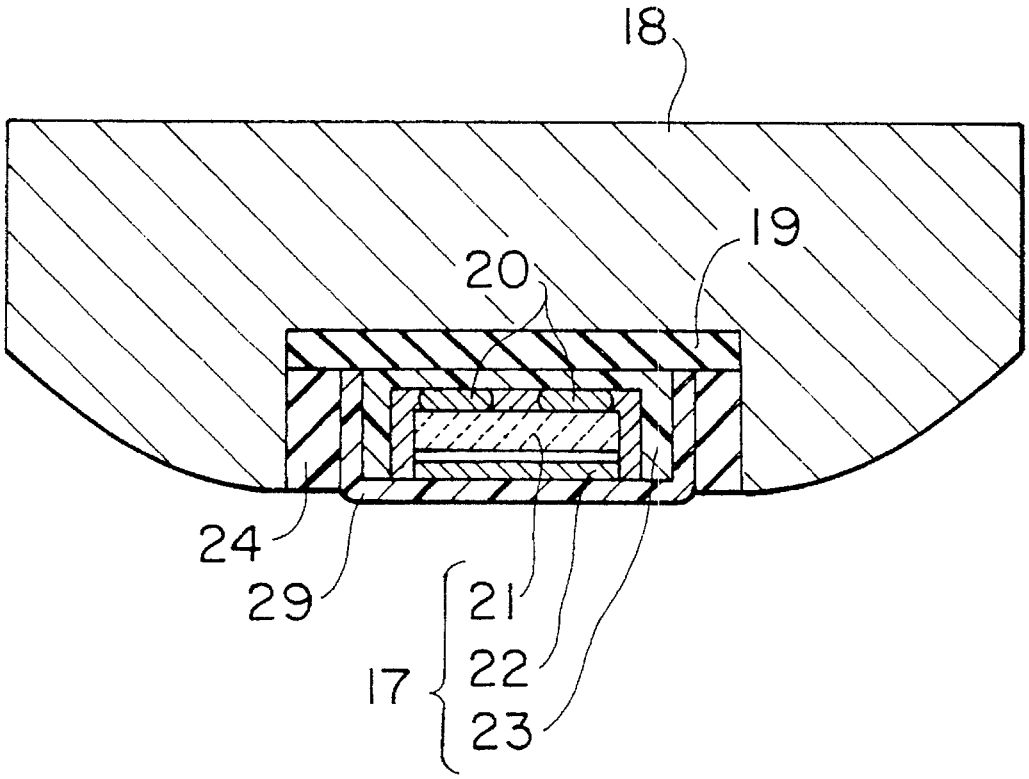

FIGS. 9A and 9B show still another embodiment of the present invention. The heating unit 17 is formed by enclosing, with the heat-insulating frame 23, the PTC heating element with a heat radiant plate 22 bonded thereto, together with conductor wires 20. As shown in FIG. 9A, the heating unit 17 is enclosed by a film 29 which is prepared by coating the surface of a heat-resistant resin such as polyimide, polyether imide or the like with a fluororesin 31 such as PTFE. This assembly is received in a recess in the holder through the intermediary of an elastic member 19. Consequently, higher insulation is attained both thermally and electrically between the heating unit 17 and the holder 18.

Figure 10:
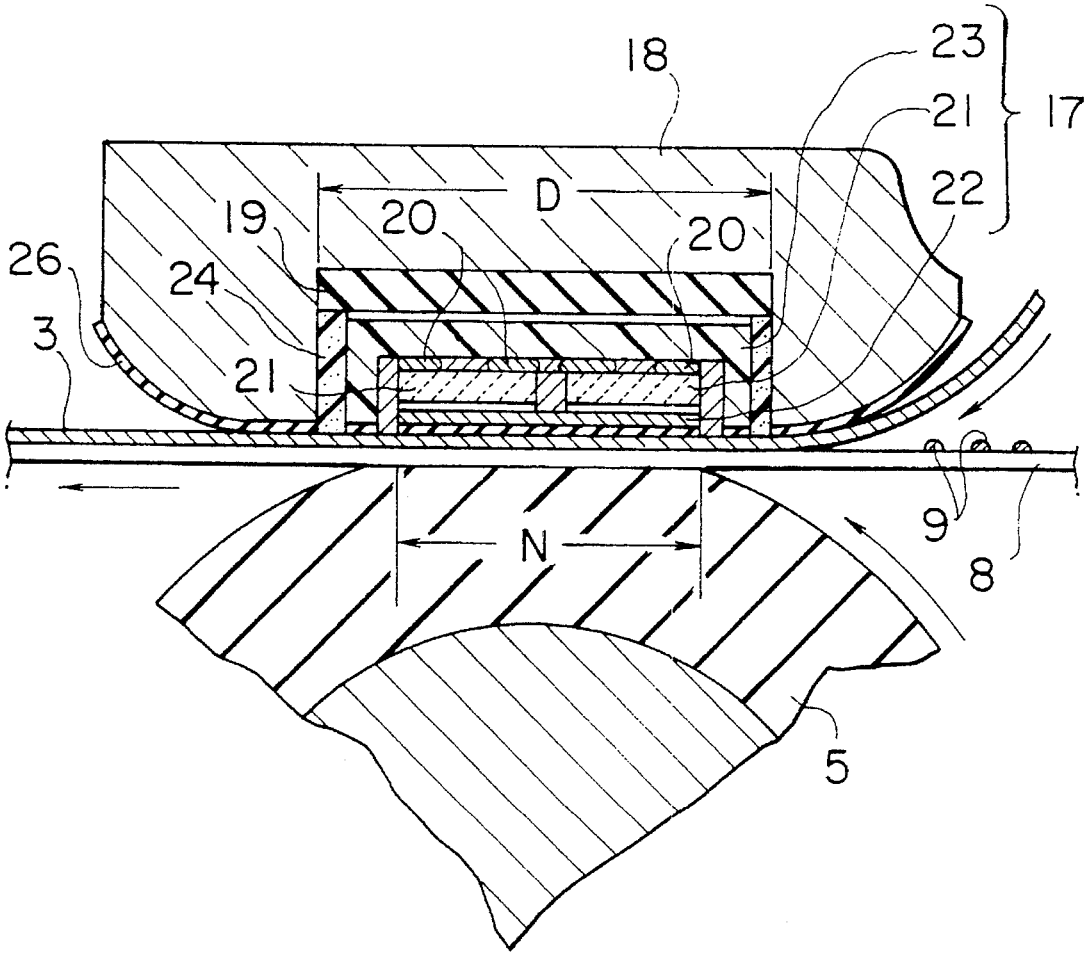
FIG. 10 is a cross-sectional view of the heating head of a still further embodiment of the present invention.

FIG. 10 is a view explanatory of a further embodiment of the present invention. The PTC heating element chips 21 are arranged in two rows on a radiant plate 22. According to this arrangement, since PTC heating element chips 21 are arranged in two rows, the nip N can be made wider without increasing the width of each of the PTC heating element chips 21, thus affording quicker fixing. By combining the PTC heating element chips having different Curie temperatures, the temperature distribution within the nip can be determined freely in such a manner, for example, that the temperature will be higher at the upstream end of the nip and lower at the downstream end thereof. Although in this embodiment the PTC heating element chips 21 are arranged in two rows, it will be obvious that these chips may be arranged in three or greater number of rows.

Figure 11A:
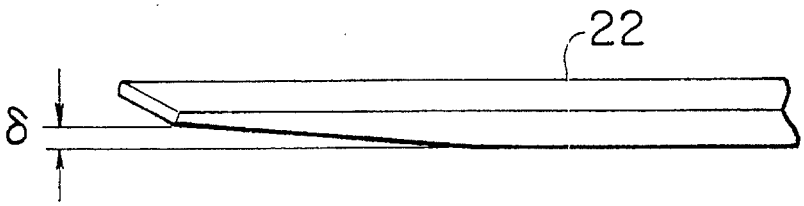
FIGS. 11A and 11B are views illustrative of a heat fixing device of a yet further embodiment of the present invention.
Figure 11B:
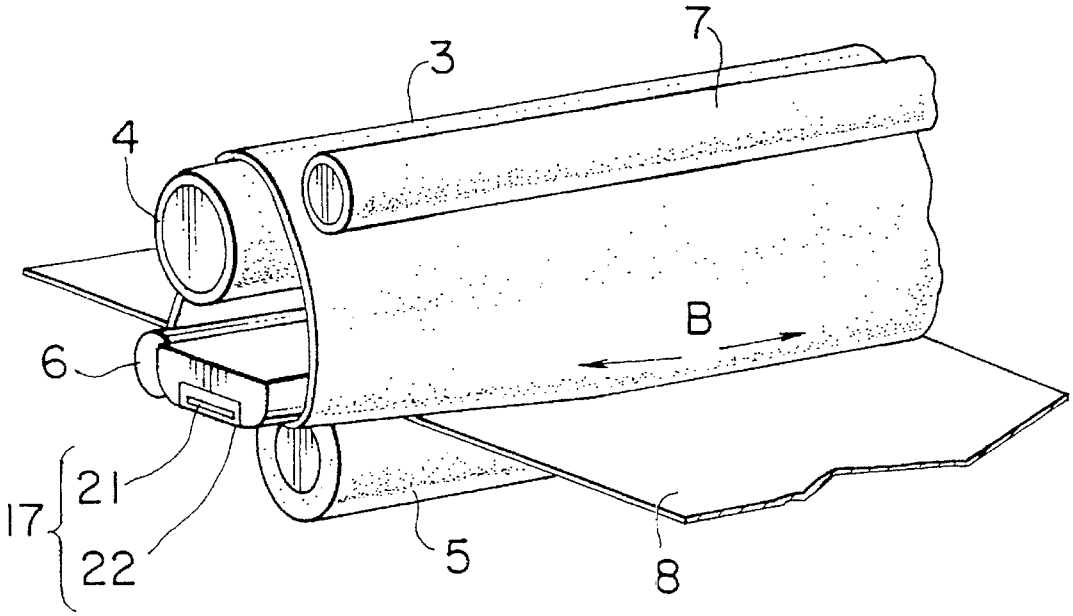

FIGS. 11A and lib are views illustrative of a still further embodiment of the present invention. In this embodiment, the longitudinal shape of the radiant plate 22 is convex, which improves the contact at a nip between the radiant plate 22 and the fixing belt 3. The convex shape helps minimize out-of-plane deformation of the fixing belt 3. The fixing belt 3 expands with heat at the nip thereof and causes out-of-plane deformation. However, since the fixing belt 3 is pressed to the radiant plate 22 having a convex shape longitudinally; that is, across the width of the fixing belt 3, the thermal expansion of the fixing belt 3 occurs in accordance with the convex shape (in an arrow-B direction), whereby the out-of-plane deformation is minimized. The amount of convexing the radiant plate 22, which is shown in FIG. 11A, is preferably 1.5 mm or less.

Figure 12A:
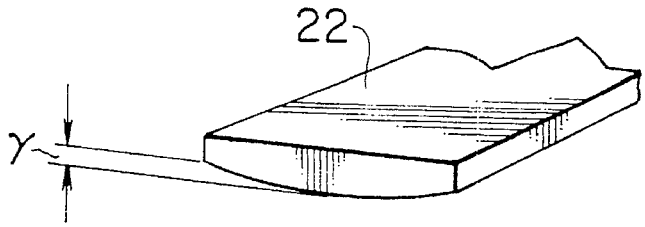
FIGS. 12A and 12B are views illustrative of a heating unit of a yet further embodiment.
Figure 12B:
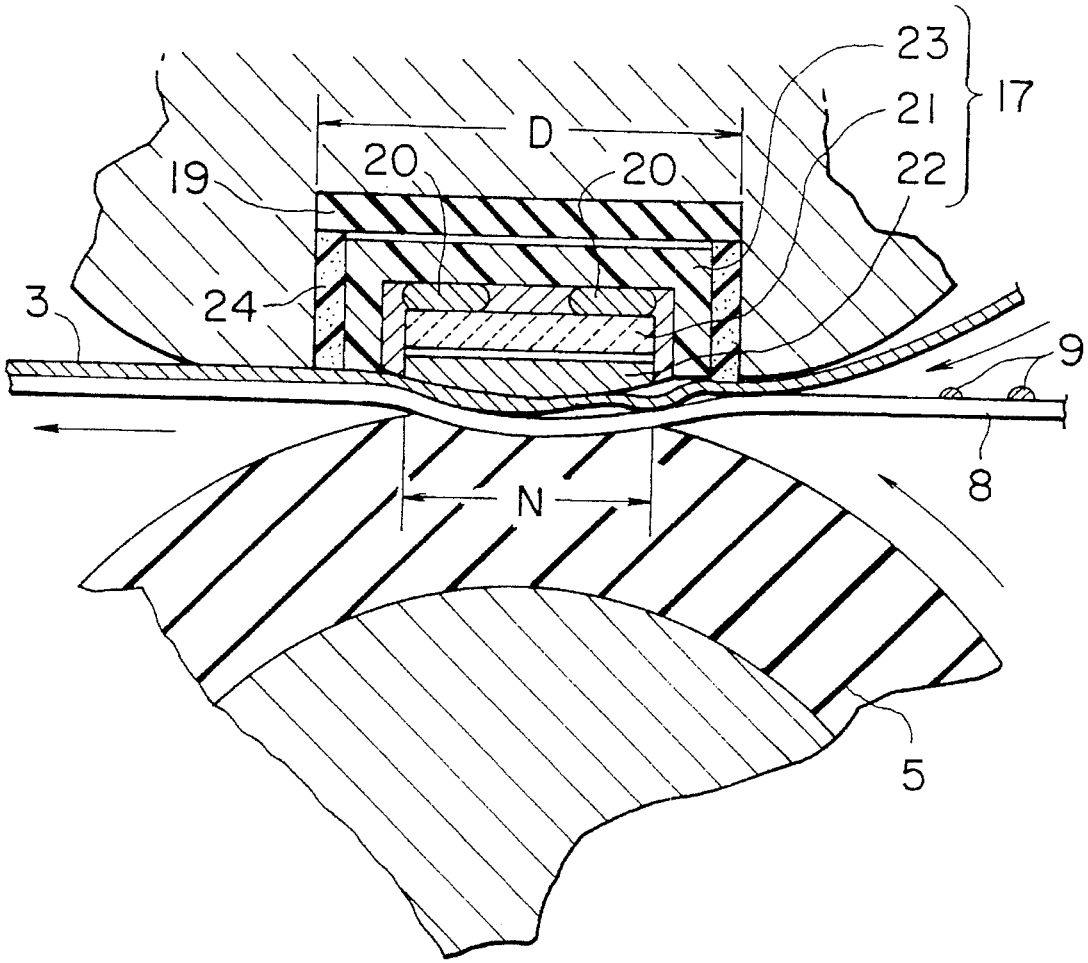

FIGS. 12A and 12B are views illustrative of a yet further embodiment of the present invention. In this embodiment, the radiant plate 22 is convex in the advancing direction of the fixing belt 3; that is, in the direction of conveyance of the recording material, thus improving the contact between the radiant plate 22 and the fixing belt 3. The fixing belt 3, which has been deformed out-of-plane due to thermal expansion, is pressurized while passing through the convex portion of the radiant plate 22. Consequently, the occurrence of out-of-plane deformation is minimized. The amount of the convexing the radiant plate 22 is 0.5 mm or more. The larger the amount is, the smaller the out-of-plane deformation of the belt 3 occurs. However, when the amount of convexing the radiant plate 22 is too large, if, for example, an envelope is to be conveyed, the convey speed differs between the surface of the envelope in contact with the fixing belt and the surface thereof in contact with the pressurizing roller. The envelope therefore wrinkles. An experiment was conducted to clarify the amount of convexing the radiant plate 22 that does not cause the above drawback. As a result, it has been revealed that the amount should range from 0.5 to 1.0 mm.

As will be apparent from the above description, according to the present invention, in a heat fixing device that performs belt-type heat fixing using a PTC heating element, the PTC heating element and a radiant plate are attached to each other using an adhesive having an excellent thermal conductivity and then enclosed with a heat-insulating material, thus forming a heating unit. This structure eliminates the pinch effect of the PTC heating element. The heating unit is isolated from heat using a heat- and electrically-insulating material and embedded in a recess in a holder via an elastic member, thus forming a heating head. This structure can prevent the imperfect thermal contact deriving from the thermal deformation of the heating unit, holder, or fixing belt, and the imperfect electric contact between the PTC heating element and electrodes. The surface of the heating head contacting the fixing belt is coated with a heat resistant lubricant, which improves the sliding smoothness between the heating unit and fixing belt. Consequently, the belt-type heat fixing device using a PTC heating element can offer a higher fixing efficiency and a higher reliability. This provides an electrophotographic apparatus which does not require temperature control of the heat fixing device and which can operate with reduced power consumption.

What is claimed is:

1. A heating fixing device, comprising:

an endless heat resistant belt;

a driving roller for rotating said heat resistant belt; and a holder contactable with said heat resistant belt and having a recess; and a PTC heating element having a positive temperature coefficient characteristic and received in the recess in said holder with an elastic member interposed therebetween.

2. A heat fixing device, comprising:

an endless heat resistant belt;

a driving roller for rotating said heat resistant belt; and a holder contactable with said heat resistant belt and having a recess;

a PTC heating element having a positive temperature coefficient characteristic and received in the recess in said holder with a heat-insulating and electrically-insulating member interposed therebetween; and an elastic member interposed between said heat-insulating and electrically-insulating member and said recess.

3. A heat fixing device according to claim 1, wherein a radiant plate is attached to a radiant surface of said PTC heating element by means of an adhesive having an excellent thermal conductivity.

4. A heat fixing device according to claim 2, wherein a radiant plate is attached to a radiant surface of said PTC heating element by means of an adhesive having an excellent thermal conductivity.

5. A heat fixing device according to claim 3, wherein said radiant plate has a surface abutting on said heat resistant belt and said surface is coated with electrical-insulating material having excellent lubricity.

6. A heat fixing device according to claim 4, wherein said radiant plate has a surface abutting on said heat resistant belt and said surface is coated with an electrical-insulating material having excellent lubricity.

7. A heat fixing device according to claim 1, wherein said PTC heating element and said holder having the recess receiving said element form a heating head, and wherein said heating head has a surface contacting said heat resistant belt and said surface is coated with an electrically-insulating material having excellent lubricity.

8. A heat fixing device according to claim 2, wherein said PTC heating element and said holder having the recess receiving said element form a heating head, and wherein said heating head has a surface contacting said heat resistant belt and said surface is coated with an electrically-insulating material having excellent lubricity.

9. A heat fixing device according to claim 1, wherein said elastic member has a rubber hardness ranging from 50° to 70°.

10. A heat fixing device according to claim 2, wherein said elastic member has a rubber hardness ranging from 50° to 70°.

11. A heat fixing device comprising:

an endless heat resistant belt;

a driving roller for rotating said heat resistant belt;

a holder contactable with said heat resistant belt and having a recess; and a PTC heating element having a positive temperature coefficient characteristic and received in the recess in said holder with a heat-insulating and electrically-insulating member interposed therebetween, wherein said holder is made of an electrically-insulating material.

12. A heat fixing device according to claim 1, wherein said holder is made of an electrically-insulating material.

13. A heat fixing device according to claim 2, wherein said holder is made of an electrically-insulating material.

14. A heat fixing device according to claim 1, wherein said PTC heating element comprises of chips which are arranged in a row on a radiant plate attached to a radiant surface of said PTC heating element and are received in said recess in said holder.

15. A heat fixing device according to claim 2, wherein said PTC heating element comprises of chips which are arranged in a row on a radiant plate attached to a radiant surface of said PTC heating element and are received in said recess in said holder.

16. A heat fixing device according to claim 1, wherein said PTC heating element comprises of chips which are arranged in rows on a radiant plate attached to a radiant surface of said PTC heating element and are received in said recess in said holder.

17. A heat fixing device according to claim 2, wherein said PTC heating element comprises of chips which are arranged in rows on a radiant plate attached to the radiant surface of said PTC heating element and are received in said recess in said holder.

18. A heat fixing device according to claim 3, wherein said radiant plate has a convex surface contacting said heat resistant belt.

19. A heat fixing device according to claim 4, wherein said radiant plate has a convex surface contacting said heat resistant belt.

20. A heat fixing device, comprising:

an endless heat resistant belt;

a driving roller for rotating said heat resistant belt;

a holder that contacts said heat resistant belt and holds a PTC heating element having a positive temperature coefficient characteristic;

a radiant plate attached to a radiant surface of said PTC heating element by an adhesive having excellent thermal conductivity, said PTC heating element having a surface other than the one to which said radiant plate is attached, said other surface being coated with an adiabatic and electrically-insulating material, said PTC heating element being received in a recess formed in said holder with an elastic member interposed therebetween; and a coating of an insulating material having excellent lubricity formed on at least the surface of said radiant plate contacting said heat resistant belt.

21. An electrophotographic apparatus, comprising:

a photosensitive drum;

means for forming an electrostatic latent image on a surface of said photosensitive drum;

developing means for developing the electrostatic latent image formed on the surface of said photosensitive drum and producing a toner image;

transfer means for transferring the toner image onto a sheet; and heating fixing means for fixing the thus transferred toner image onto said sheet;

said heat fixing means comprising a heat fixing device comprising an endless heat resistant belt, a driving roller for rotating said heat resistant belt, a holder contactable with said heat resistant belt and having a recess, and a PTC heating element having a positive temperature coefficient characteristic and received in the recess in said holder with an elastic member interposed therebetween.

22. An electrophotographic apparatus, comprising:

a photosensitive drum;

means for forming an electrostatic latent image on a surface of said photosensitive drum;

developing means for developing the electrostatic latent image formed on the surface of said photosensitive drum and producing a toner image;

transfer means for transferring the toner image onto a sheet; and heating fixing means for fixing the thus transferred toner image onto said sheet;

said heat fixing means comprising a heat fixing device comprising an endless heat resistant belt, a driving roller for rotating said heat resistant belt, a holder contactable with said heat resistant belt and having a recess, a PTC heating element having a positive temperature coefficient characteristic and received in the recess in said holder with a heat-insulating and electrically-insulating member interposed therebetween, and an elastic member interposed between said heat-insulating and electrically-insulating member and said recess.

23. An electrophotographic apparatus, comprising:

a photosensitive drum;

means for forming an electrostatic latent image on a surface of said photosensitive drum;

developing means for developing the electrostatic latent image formed on the surface of said photosensitive drum and producing a toner image;

transfer means for transferring the toner image onto a sheet; and heating fixing means for fixing the thus transferred toner image onto said sheet;

said heat fixing means comprising a heat fixing device comprising an endless heat resistant belt, a driving roller for rotating said heat resistant belt, a holder that contacts said heat resistant belt and holds a PTC heating element having a positive temperature coefficient characteristic, a radiant plate attached to a radiant surface of said PTC heating element by an adhesive having excellent thermal conductivity, said PTC heating element having a surface other than the one to which said radiant plate is attached, said other surface being coated with an adiabatic and electrically-insulating material, said PTC heating element being received in a recess formed in said holder with an elastic member interposed therebetween, and a coating of an insulating material having excellent lubricity formed on at least the surface of said radiant plate contacting said heat resistant belt.

* * * * *